US005401461A

United States Patent [19]

Hartzell et al.

[11] Patent Number: 5,401,461

[45] Date of Patent: Mar. 28, 1995

[54] CEMENTED CARBIDE BODY USED PREFERABLY FOR ABRASIVE ROCK DRILLING AND MINERAL CUTTING

[75] Inventors: E. Torbjorn Hartzell; Jan Akerman, both of Stockholm; Udo K. R. Fischer, Vallingby, all of Sweden

[73] Assignee: Sandvik AB, Sandviken, Sweden

[21] Appl. No.: 124,542

[22] Filed: Sep. 22, 1993

Related U.S. Application Data

[62] Division of Ser. No. 836,563, Feb. 18, 1992, Pat. No. 5,286,549.

[30] Foreign Application Priority Data

Feb. 18, 1991 [SE] Sweden ..... 9100482

[51] Int. Cl.[6] ..... B22F 3/12

[52] U.S. Cl. ..... 419/14; 419/11; 419/15; 419/18; 419/38

[58] Field of Search ..... 264/56; 419/18, 14, 419/15, 11, 38

[56] References Cited

U.S. PATENT DOCUMENTS 4,743,515 5/1988 Fischer ..... 428/698

5,158,148 10/1992 Keshavan ..... 51/307

*Primary Examiner*—James Derrington

*Attorney, Agent, or Firm*—Burns, Doane, Swecker & Mathis

[57] ABSTRACT

The present invention relates to cemented carbide bodies preferably for wear demanding rock drilling and mineral cutting. The bodies are built up of a core of eta-phase-containing cemented carbide surrounded by a surface zone free of eta-phase where the binder phase content in the outer pan of said zone is lower than the nominal and, in addition, constant or near constant, and the binder phase content in the inner part of the eta-phase free zone closer to the eta-phase core is higher than the nominal. According to the method of the invention, bodies comprising evenly distributed eta-phase are subjected to a partly carburizing treatment with a carbon activity, $a_c$, close to 1.

1 Claim, 1 Drawing Sheet

CEMENTED CARBIDE BODY USED PREFERABLY FOR ABRASIVE ROCK DRILLING AND MINERAL CUTTING

This application is a divisional of application Ser. No. 07/836,563, filed Feb. 18, 1992, now U.S. Pat. No. 5,286,549.

BACKGROUND OF THE INVENTION

The present invention relates to cemented carbide bodies useful in tools for rock drilling and mineral cutting. Tools for cutting asphalt and concrete are also included.

In U.S. Pat. No. 4,743,515 cemented carbide bodies are disclosed with a core of fine and evenly distributed eta-phase embedded in the normal alpha+beta−phase structure, and a surrounding surface zone of only alpha+beta−phase. (Alpha=tungsten carbide, beta =binder phase, e.g., Co, and eta=$M_6C$, $M_{12}C$ and other carbides, e.g., $W_3Co_3C$). An additional condition is that in the inner part of the surface zone situated close to the core, the Co-content is higher than the nominal content of Co (with nominal is meant here and henceforth the weighed-in amount of Co). In addition, the Co-content in the outermost part of the surface zone is lower than the nominal and increases in the direction towards the core up to a maximum situated in the zone free of eta-phase. The zones free of eta-phase may, e.g., be created by adding carbon at high temperature to the surface zone of a body with eta-phase throughout.

Cemented carbide bodies, according to U.S. Pat. No. 4,743,515 have shown increased performance for all cemented carbide grades normally used in rock drilling and have been a commercial success. Because the binder phase content increases from the outer surface towards the center, the improved wear resistance is lost relatively early in the drilling process. Cemented carbide bodies according to U.S. Pat. No. 4,743,515 are therefore best suited for rock drilling operations demanding toughness in the bits.

High wear resistance and high penetration rate are essential properties for bits and these properties are becoming more and more important. Certain bits, in particular bits for drifting, are worn out when the diameter of the bit has decreased with 4–6 mm since the diameter of the drill hole becomes too small, thus making the blasting agent difficult to charge. Buttons in such bits are therefore seldom reground because the bit diameter usually decreases when reground. For these bits, it is important that the buttons have a 2–3 mm thick, wear resistant zone so that the wear resistance is high and uniform during the whole life of the bit. The penetration rate depends on the shape of the button. The buttons are therefore as a rule given a shape which give optimal penetration rate. When the shape of the button is changed by wear, the penetration rate decreases successively.

OBJECTS AND SUMMARY OF THE INVENTION

It is an object of this invention to avoid or alleviate the problems of the prior art.

It is also an object of this invention to provide a cemented carbide body for use in rock drilling and mineral cutting which has an increased wear resistance.

In one embodiment of the invention there is provided a cemented carbide body preferably for use in rock drilling and mineral cutting, comprising WC (alpha-phase) and a binder phase based on at least one of Co, Fe and Ni and comprising a core of eta-phase-containing cemented carbide surrounded by a surface zone with an outer part of the surface zone having a lower binder phase content than the nominal, the binder phase content in the outer part of the surface zone being substantially constant.

In another embodiment there is provided a method of manufacturing a cemented carbide body .by metallurgical methods comprising sintering a powder with substoichiometric carbon content to an eta-phase-containing body and partially carburizing the sintered body under conditions including a carbon activity of at least 0.8 to form a body containing an eta-phase-containing core surrounded by an eta-phase free surface zone.

Figure 1:
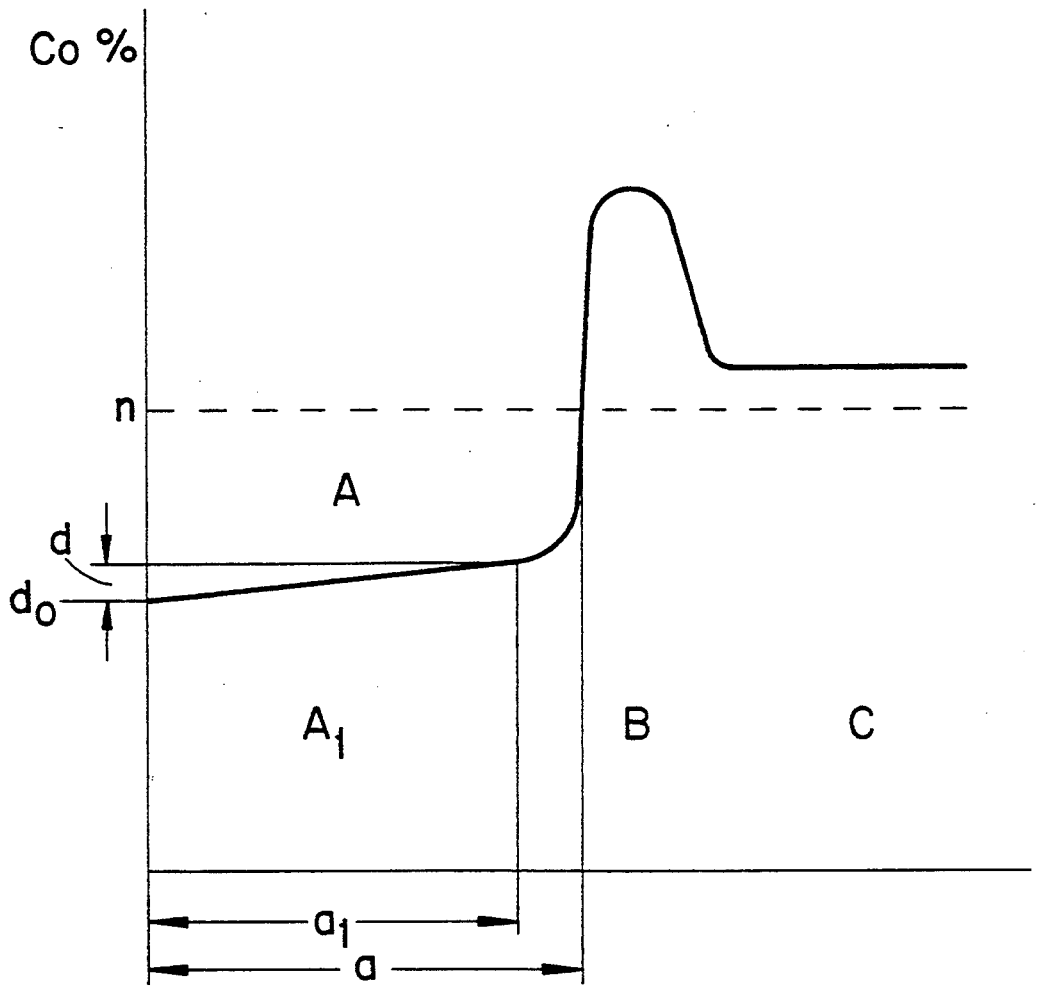
FIG. 1 is a schematic representation of the binder phase distribution along a line perpendicular to the surface of a cemented carbide body according to the invention.

A binder phase depleted surface zone $A_1$ surface zone with almost constant content of binder phase B binder phase rich surface zone C eta-phase containing core n nominal binder phase content $d_o$ binder phase content in the surface d increase in binder phase content in zone $A_1$ a width of the binder phase depleted surface zone $a_1$ width of the surface zone with almost constant binder phase content

DETAILED DESCRIPTION OF THE PREFERRED EMBODIMENTS OF THE INVENTION

It has now surprisingly turned out that it is possible to control the manufacturing process in such a way that a substantially constant content of binder metal is obtained in the surface zone of the body of WC-(Fe, Co, Ni)-based binder phase and as a result, a substantially constant hardness and wear resistance. Thereby, further improvement is obtained in applications where high wear resistance is of great importance. The wear resistant surface zone in bodies according to the invention is worn more slowly than in conventional bodies and therefore a high penetration rate is maintained during long time.

The eta-phase free surface zone in cemented carbide bodies according to the invention, is divided into two parts as shown in FIG. 1. In the outermost part (zone A), the binder phase content is lower than the nominal (n). In the inner part (zone B), the binder phase content is higher than the nominal. Zone A has higher hardness and stiffness due to the low binder phase content whereas zone C has higher hardness due to the finely dispersed eta-phase.

In zone A, the average content of binder phase is 0.2–0.8, preferably 0.3–0.7, of the nominal binder phase content. The binder phase content in the outer part of zone A is substantially constant. The relative increase or decrease in binder phase content along a line perpendicular to the surface, $d/(d_o.a_1)$ should not be greater than 20%/mm, preferably not greater than 10%/min. The width, $a_1$, of this outer zone with constant or almost constant binder phase content shall be 50%, preferably 70%, most preferably 80%, of the width, a, of zone A, with a minimum width of at least 1 mm. In zone B, the binder phase content is higher than the nominal, and reaches a highest value of at least 1.2, preferably 1.6–3, of the nominal binder phase content.

Zone C shall contain at least 2%, preferably at least 5%, by volume of eta-phase but at the most 60%, preferably at the most 35%, by volume. The eta-phase shall be fine-grained with a grain size of 0.5–10/μm, preferably 1–5/μm, and be evenly distributed in the matrix of the normal WC-Co structure. The width of zone C shall be 10–95%, preferably 25–75%, of the cross section of the cemented carbide body.

The invention can be used for all cemented carbide grades normally used for rock drilling from grades with 3% by weight binder phase up to grades with 25% by weight binder phase. Preferably, these cemented carbides contain 5–10% by weight binder phase for percussive drilling, 10–25% by weight for rotary-crushing drilling and 6–13% by weight for rock cutting. The grain size of WC can vary from 1.5/μm up to 8 μm, preferably 2–5 μm. The present invention is particularly suitable for bits that are not reground, e.g., for drill bits for drifting where the bit has reached the scrap diameter before the zone with constant binder phase content is worn away. The big difference in binder phase content, and concomitantly the difference in the thermal expansion coefficient, between zone A and the remaining zones in a button according to the invention results in high compressive stresses in the surface of the buttons which leads to extraordinary good toughness properties in parallel with the previously mentioned improvements in wear resistance.

In the binder phase, Co can be replaced partly or completely by Ni and/or Fe. When so done, the Co fraction in the eta-phase is partly or completely replaced by some of the metals Fe and/or Ni, i.e., the eta-phase itself can contain one or more of the iron group metals in combination. Up to 15% by weight of tungsten in the alpha-phase can be replaced by one or more of the metallic carbide formers Ti, Zr, Hf, V, Nb, Ta, Cr and Mo.

Cemented carbide bodies according to the invention are manufactured according to powder metallurgical methods: milling, pressing and sintering. By starting from a powder with substoichiometric content of carbon, an eta-phase containing cemented carbide is obtained during the sintering. This body, after the sintering, is given a vigorously carburizing heat treatment, e.g., by packing it in carbon black. This means that the carbon activity, $a_c$, in the atmosphere of the furnace shall be close to 1, preferably at least 0.8, so that transport of carbon to the surface of the buttons during the entire heat treatment time is greater than the diffusion rate of carbon into the buttons.

The invention is additionally illustrated in connection with the following Examples which are to be considered as illustrative of the present invention. It should be understood, however, that the invention is not limited to the specific details of the Examples.

EXAMPLE 1

Buttons were pressed using a WC-6 weight % Co powder with 0.2% by weight substoichiometric carbon-content (5.6% by weight C instead of 5.8% by weight). These were sintered at 1450° C. under standard conditions. After sintering, the length of the buttons was 16 mm and the diameter was 10 mm. The buttons were then packed in carbon black and heat treated in a furnace for 3 hours at 1400° C.

The buttons manufactured in this way comprised a 2 mm wide surface zone free of eta-phase and a core with a diameter of 6 mm containing finely dispersed eta-phase. The Co-content at the surface was .measured to be 3% by weight. 1.6 mm from the surface, the Co content was 3.5% by weight and just outside the eta-phase-core, 14% by weight. The width of the zone with high Co-content was about 0.4 mm.

EXAMPLE 2

Rock: Hard abrasive granite with streaks of leptite, compressive strength 2800–3100 bar.

Machine: Arias Copco COP 1038 HD, a hydraulic machine for heavy drifter equipment. Feeding pressure 85 bar, rotation pressure 45 bar and rotation 200 rpm.

Bits: 45 mm two-wing button bits with the periphery buttons 10 mm in diameter and 16 mm in length. 10 bits per variants were tested. The scrap diameter was 41 mm.

Cemented carbide grade: 94% by weight WC and 6% by weight Co. Grain size—2.5 μm.

Test variants

1. Buttons according to the invention comprising and eta-phase core with a diameter of 4 mm, a surface zone free of eta-phase 3 mm wide in which the low Co-content part was 2.2 mm wide.
2. Buttons comprising an eta-phase core with a diameter of 6 mm, a surface zone free of eta-phase of 2 mm with a Co-gradient according to U.S. Pat. No. 4,743,515.
3. Buttons with normal structure without eta-phase.

The bits were drilled in campaigns of 7 holes, depth 5 m and were permuted in such a way that equal drilling conditions were obtained. The bits were taken out from the test as soon as the bit diameter fell below 41 mm and then the drilled meters were recorded.

| | Result: Life length, m | | |
|---|---|---|---|
| Variant | average | maximum | minimum |
| 1 | 451 | 543 | 398 |
| 2 | 325 | 403 | 286 |
| 3 | 231 | 263 | 201 |

EXAMPLE 3

Test drilling with 64 mm bench drilling bits were made in a quartzite quarry containing very hard quartz. Variant 1 was equipped with cemented carbide buttons according to the invention, variant 2 equipped with buttons according to U.S. Pat. No. 4,743,515 and variant 3 equipped with a WC-Co-grade commonly available on the market. The buttons according to the invention as well as the buttons according to U.S. Pat. No. 4,743,515 comprised a 2.5 mm wide surface zone with low Co-content.

Test data:

Drilling rig: ROC 712 with a COP 1036 machine
Feeding pressure: 80 bar
Impact pressure: 190 bar
Hole depth: 12 m
Air flushing: 5 bar
Number of bits: 5

| Variant | Result: Regrinding interval, m | No. of regrindings | Life m | Index |
|---|---|---|---|---|
| 1 | 48 | 3 | 189 | 145 |
| 2 | 36 | 4 | 157 | 120 |
| 3 | 24 | 5 | 130 | 100 |

EXAMPLE 4

Test site: Iron ore mine—open pit. Drilling with roller bits.

Drilling machine: Gardner Denver GD-100.

Feeding pressure: 40 tons.

Rotation: 80 rpm.

Type of rock: Magnetite with streaks of quartz and slate.

Drill bit: 12¼" CS-2.

Variant 1: Bit with cemented carbide buttons (chisel-shaped) according to the invention. The nominal Co-content was 10% by weight, the button diameter was 14 mm and the length was 2 1 ram. Zone A was 3 mm and zone B was 2 min.

Variant 2: Cemented carbide buttons according to prior art, with a surface zone free of eta-phase of 2.5 mm and a nominal Co-content of 10% by weight.

Variant 3: Cemented carbide buttons of a conventional grade with 10% Co by weight.

| Variant | Result: Life length, m | Penetration rate, m/h |
|---|---|---|
| 1 | 3050 | 21.2 |
| 2 | 2583 | 16.3 |
| 3 | 1868 | 15.3 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of by milling, pressing and sintering powder to produce a cemented carbide body comprising sintering a powder with substoichiometric carbon content to an eta-phase-containing body and partially carburizing the sintered body under conditions including a carbon activity of at least 0.8 to form a body containing an eta-phase-containing core surrounded by an eta-phase free surface zone and a substantially constant content of binder metal in the outer part of the surface zone.

* * * * *